United States Patent [19]

Takada et al.

[11] 4,450,878

[45] May 29, 1984

[54] APPARATUS FOR FILLING A HIGH TEMPERATURE LIQUID INTO A BIAXIALLY ORIENTED, SATURATED POLYESTER BOTTLE, A DEVICE FOR COOLING SAID BOTTLE

[75] Inventors: Takuzo Takada; Hiroaki Sugirua; Takao Ilzuka, all of Tokyo, Japan

[73] Assignee: Yoshino Kogyosho Co., Ltd., Tokyo, Japan

[21] Appl. No.: 65,505

[22] Filed: Aug. 13, 1979

[30] Foreign Application Priority Data

| | | | |
|---|---|---|---|
| Aug. 12, 1978 | [JP] | Japan | 53-98321 |
| Sep. 6, 1978 | [JP] | Japan | 53-122323[U] |
| Sep. 6, 1978 | [JP] | Japan | 53-122324[U] |
| Sep. 14, 1978 | [JP] | Japan | 53-113077 |
| Sep. 27, 1978 | [JP] | Japan | 53-132533[U] |

[51] Int. Cl.[3] ..... B65B 31/00

[52] U.S. Cl. ..... 141/48; 141/82; 53/440

[58] Field of Search ..... 426/399, 401; 53/440; 141/1, 82, 48, 91, 92, 2–12, 37–47, 49–70, 114, 313–317, 82, 129–191; 215/1 C

[56] References Cited

U.S. PATENT DOCUMENTS

| | | | |
|---|---|---|---|
| 717,720 | 1/1903 | Schofield | 141/82 |
| 1,822,614 | 9/1931 | Darling | 141/91 |
| 2,498,401 | 2/1950 | Duncan | 141/82 |
| 2,745,150 | 7/1973 | Corsover | 215/1 C |
| 2,897,082 | 7/1959 | Kaiser | 141/82 |
| 3,097,658 | 7/1963 | Runco | 141/92 |
| 3,900,120 | 8/1975 | Sincock | 215/1 C |
| 3,948,404 | 4/1976 | Collins et al. | 215/1 C |
| 4,040,233 | 8/1977 | Valyi | 426/399 |
| 4,233,022 | 11/1980 | Brady et al. | 215/1 C |

FOREIGN PATENT DOCUMENTS

| | | | |
|---|---|---|---|
| 1158398 | 11/1963 | Fed. Rep. of Germany | 53/440 |
| 2604009 | 8/1977 | Fed. Rep. of Germany | 426/399 |

*Primary Examiner*—Houston S. Bell, Jr.

*Attorney, Agent, or Firm*—Fidelman, Wolffe & Waldron

[57] ABSTRACT

A biaxially stretched molded bottle is forcibly cooled by having its outer surface contacted with a cooling fluid such as cold water or gas to avoid its deformation by the heat of a liquid poured into the bottole and elution by such heat of any constituent of the material from which it is molded, when the bottle is a molded product of a saturated polyester resin, particularly polyethylene terephthalate, which has poor heat resistance like bottles of other synthetic resins, and is filled with the liquid which is heated to a high temperature for sterilization purpose only when it is filled into such a bottle and which is allowed to return to room temperature or cooled. When the liquid is poured into the bottle through its open neck, the cooling fluid supplied for cooling the bottle is prevented from flowing into the bottle through its open neck and mixing impurities into the liquid in the bottle. Moreover, an structural improvement has been introduced to avoid any interaction of thrust between the neck of the bottle and the seal covers brought into contact therewith in order to prevent thermal deformation of the neck of the bottle which is difficult to cool with the cooling fluid.

2 Claims, 14 Drawing Figures

APPARATUS FOR FILLING A HIGH TEMPERATURE LIQUID INTO A BIAXIALLY ORIENTED, SATURATED POLYESTER BOTTLE, A DEVICE FOR COOLING SAID BOTTLE

This invention relates to a method of filling smoothly and properly a bottle formed by biaxially stretching saturated polyester resin, especially polyethylene telephthalate, with hot contents maintained at a high temperature for sterilization of like purposes only at the time of such filling, a cooling device used in carrying out this method, and bottle neck construction which is beneficial for carrying out the method.

Polyethylene terephthalate is used in many fields of application owing to its excellent physical properties and durability. Above all, it is most often used to make biaxially stretched, blow molded bottle-shaped containers in which its excellent physical properties and durability are most effectively displayed.

Although these biaxially stretched bottles molded from polyethylene terephthalate have a lot of excellent advantages, they have been as poor in heat resistance as other synthetic resin bottles.

When these bottles are filled with their contents treated at a high temperature for the purpose of sterilization, such as milk, juice and other drinks, these contents are in most cases at a high temperature of, say, 90° C.

Such a high temperature of the liquid to be contained in a bottle has caused its thermal deformation when it is filled with its contents, which deprives the bottle of its commercial value.

Particularly, as bottles made of polyethylene terephthalate are, all without exception, blow-molded with a considerably large degree of biaxial orientation, they have a body portion of reduced wall thickness which is susceptible to the influence of heat.

Heat setting has hitherto been considered the most effective method of improving the heat resistance of polyethylene terephthalate molded bottles which are very easily affected by heat.

Although heat setting considerably improves the heat resistance of polyethylene terephthalate molded bottles, the heat setting operation is troublesome, and yet renders the bottle resistant only up to a temperature of about 60° C. at best. Such a bottle can hardly endure the heat of its contents which are charged into it after sterilization at a higher temperature of 80° to 90° C.

The introduction into a bottle of its contents treated at a high temperature for sterilization is stopped with some vacant space left in the neck of the bottle before the neck is completely filled with a liquid, so that vibration of the bottle upon movement may not cause leakage of its contents. This is not only true with a bottle formed from saturated polyester resin, but with a glass bottle as well.

The neck of a bottle molded from saturated polyester resin with biaxial orientation is likely to be less resistant to heat than its body portion, because the neck portion is often not biaxially stretched during the molding operation. Therefore, the bottle is generally filled with its contents only to a level which is very close to, but short of, its mouth.

Thus, a vacant space usually called "heat space" is formed in the bottle above its contents, but if the bottle is sealed leaving the head space as it is, the various germs in the air trapped in the head space frequently cause decomposition of change in quality of the sterilized contents with the lapse of a certain length of time.

In an attempt to avoid such a problem, it has heretofore been usual to perform in a germ-free stmosphere the entire process from the filling of the bottle with its contents to its sealed closure, or provide a sterilizing device for the exclusive purpose of sterilizing the neck of the bottle when it is closed.

In spite of the great amount of expense and labor hitherto spent for sterilization of the head space, various germs have entered into the head space and caused decomposition or change in quality of the contents.

This invention has been conceived for the purpose of accomplishing smoothly the filling of a hot liquid into a biaxially stretched saturated polyester resin molded bottle. In view of the fact that the liquid needs to be at a high temperature only when it is poured into the bottle and is allowed to return to room temperature or cooled after the bottle is filled, this invention includes forcibly cooling the bottle from its outside when it is filled with its contents to prevent the bottle from being heated by the hot contents. The invention further contemplates elimination of the head space by utilizing the vapors generated by the hot contents poured into the bottle, to thereby prevent entry of air into the bottle.

It is, therefore, an object of this invention to achieve smooth pouring of a hot liquid into a biaxially stretched saturated polyester resin, particularly polyethylene terephthalate, molded bottle without causing thermal deformation of the bottle or elution of a part of the bottle material.

It is another object of this invention to enable forced cooling of the bottle, while it is filled with its contents in a usual manner.

It is still another object of this invention to ensure prevention of entry of various germs in the air into the bottle throughout the entire process of pouring a hot liquid into the bottom and sealing the bottle.

It is a further object of this invention to prevent thermal deformation of the neck of the bottom which is difficult to cool from the outside.

Other objects and advantages of the present invention will become apparent from the following description taken in conjunction with the accompanying drawings, wherein.

Figure 6:
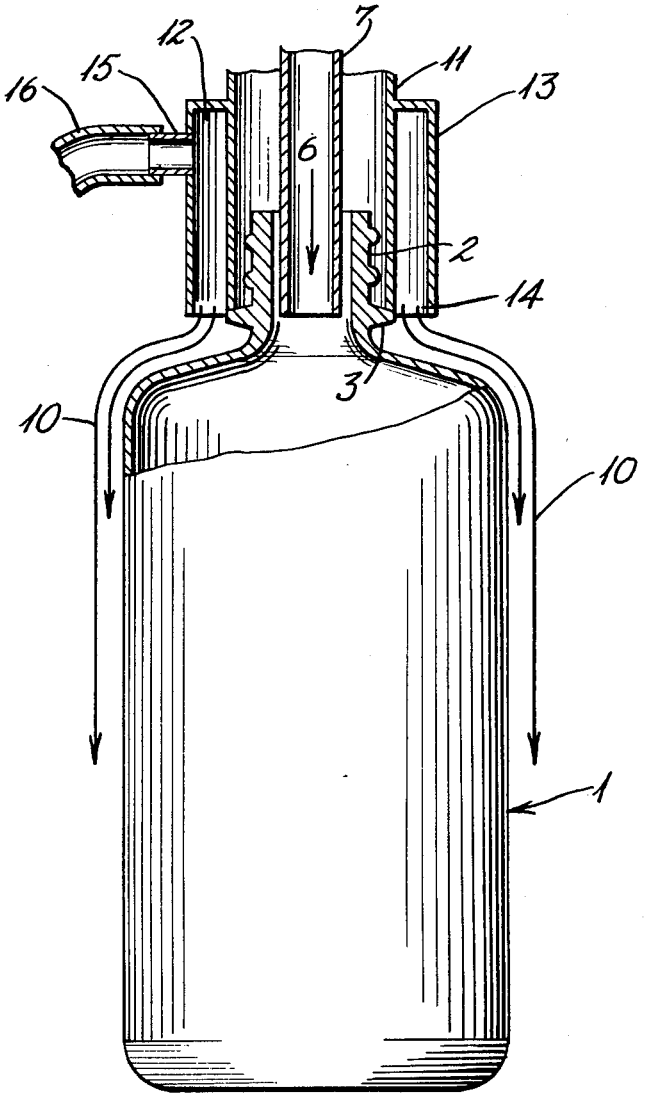
Figure 7:
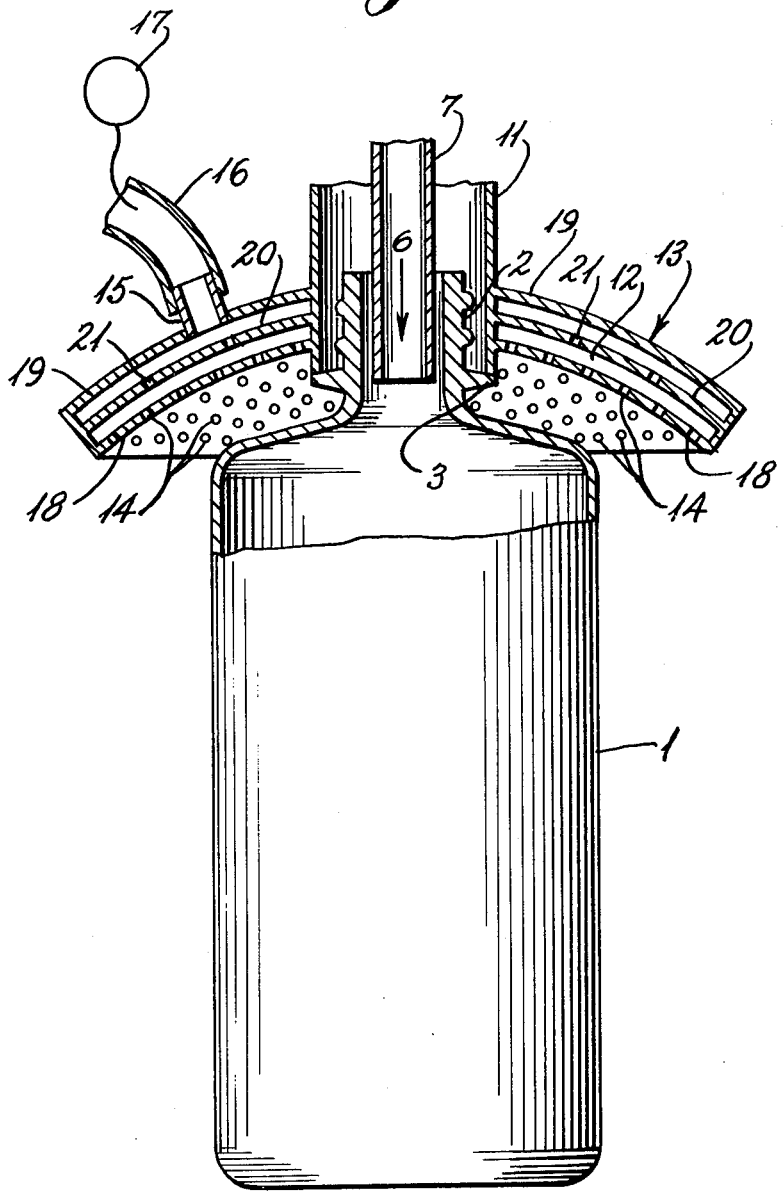
Figure 8:
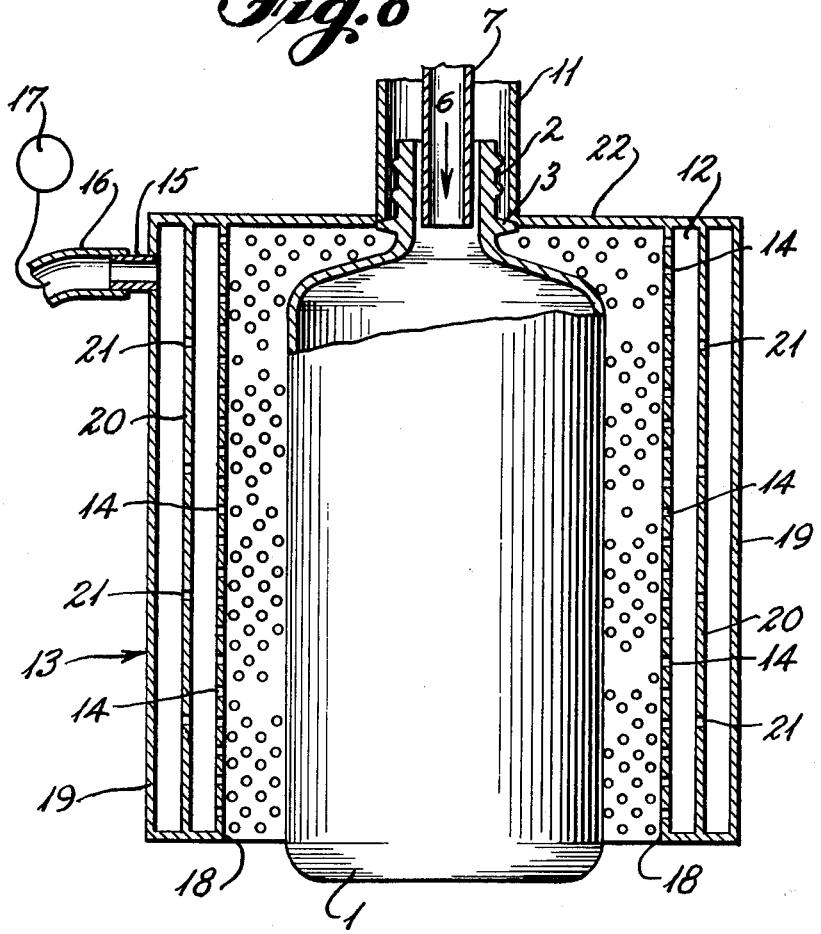
Figure 13:
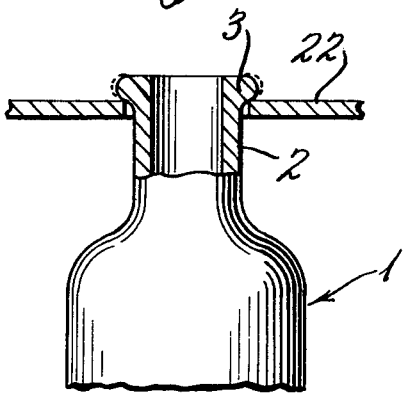
Figure 14:
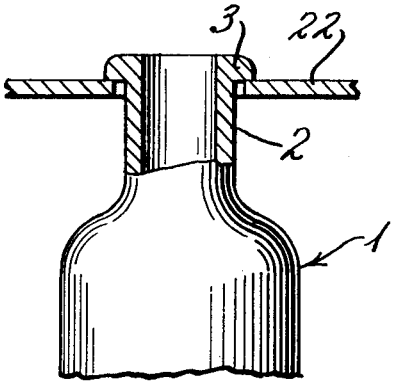
Figure 9:
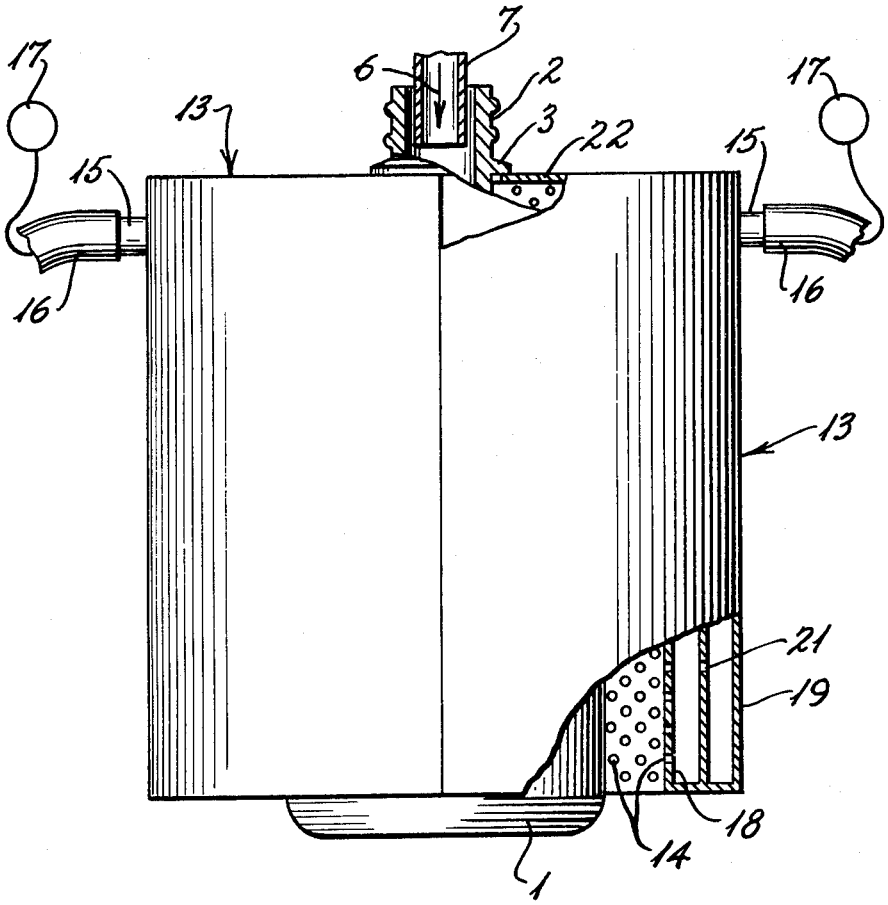
Figure 10:
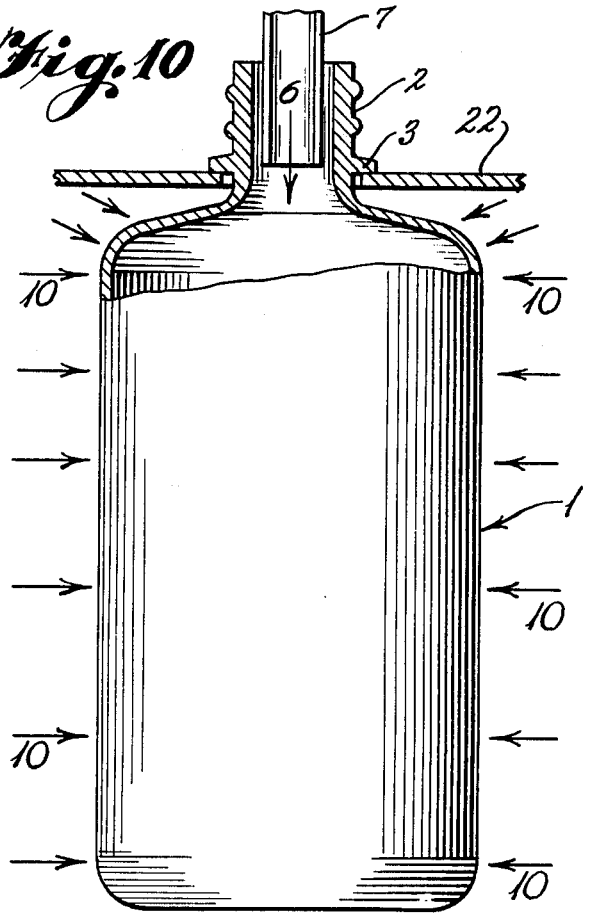
Figure 11:
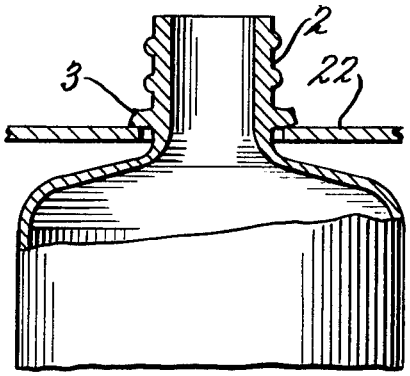
Figure 12:
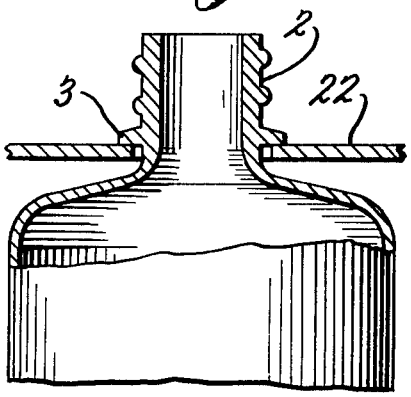

FIGS. 6 through 9 are fragmentary longitudinal cross-sectional views showing a cooling device for the bottle, FIG. 6 showing an example of the device using water as a cooling fluid, FIG. 7 showing an example using water as a cooling fluid and adapted to produce a higher and more uniform cooling effect than the example of FIG. 6, FIG. 8 showing an example using air as a cooling fluid, and FIG. 9 showing an example similar to that of FIG. 8, but having a different means for preventing the cooling fluid from flowing past the neck of the bottle; and cross-sectional views illustrating the prevention of deformation of the bottle neck which is difficult to cool when the bottle is cooled, FIG. 10 showing the step of pouring a hot liquid without using this invention, FIG. 11 showing a flange around the neck deformed by heat as the result of the pouring operation shown in FIG. 10, FIG. 12 showing a means embodying this invention for preventing the thermal deformation of the flange, FIG. 13 showing a different form of flange deformed by heat, and FIG. 14 showing a means of this invention for preventing the flange deformation shown in FIG. 13.

Figure 1:
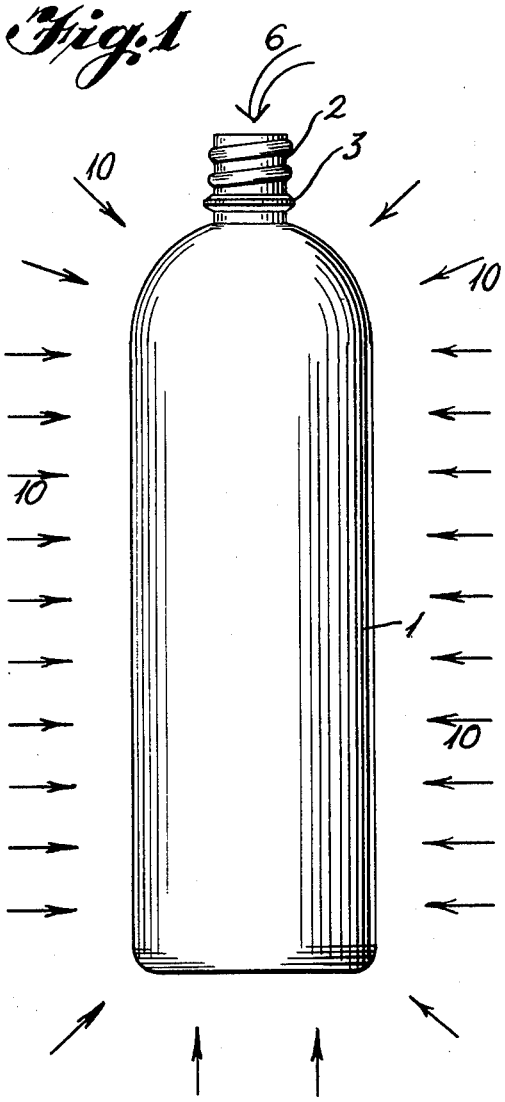
FIG. 1 is a view illustrating the most fundamental embodiment of the method of this invention.

The basic feature of this invention lies, as shown in FIG. 1, in cooling a biaxially stretched, blow molded polyolefin resin, particularly polyethylene terephthalate bottle 1, particularly its body portion when it is filled with a hot liquid 6, by contacting the entire external surface of the bottle 1 with a cooling fluid 10 such as cold water or air in such a manner that the cooling fluid 10 may not exert any strong pressure on the bottle 1.

Although the cooling of the bottle 1 with the cooling fluid 10 is better if conducted progressively on the outer surface of one portion of the bottle to another which is brought into contact with the liquid poured thereinto, such a method of cooling complicates the control of flow of the cooling fluid 10 and the construction of a cooling device; therefore, it is easier to cool the whole bottle 1 to a temperature which is suitable in view of the temperature of the liquid 6 which is poured into the bottle 1.

As the liquid 6 is poured into the bottle 1, that portion of the bottle 1 which is brought into contact with the liquid 6 is heated by the liquid 6 with a resultant reduction in the cooling effect; therefore, it is necessary to ensure that the cooling fluid 10 be maintained at a substantially constant temperature and caused to flow in contact with the outer surface of the bottle 1 in order to avoid any reduction of its cooling effect.

Such arrangement for avoiding reduction in the cooling effect of the cooling fluid 10 prevents elevation of the temperature of the wall of the bottle 1 to a level causing its thermal deformation despite the high temperature of the liquid 6, because the wall thickness of the bottle 1 is very small.

Since a biaxially stretched, blow molded polyethylene terephthalate bottle 1 of this sort usually has a very small wall thickness, it is likely that application of the cooling fluid 10 at a high pressure against the surface of the bottle 1, especially of its body portion may cause concave deformation of the body of the bottle 1. It is, therefore, important to conduct application of the cooling fluid 10 against the surface of the bottle 1 in full consideration of its quantity per unit time, temperature and flow rate (directly related to the pressure at which the cooling fluid is applied to the surface of the bottle 1) required to produce a full cooling effect.

For example, in case the bottle 1 is cooled with cold water which is considered the most effective cooling fluid for the bottle 1, it is effective to drop a large quantity of water on the shoulder of the bottle 1 to allow it to flow down along the bottle surface by its own weight, rather than directing jets of water against the surface of the bottle 1 through a multiplicity of nozzles provided opposite to it.

After the bottle 1 is filled with its contents 6 and a cap is placed on the bottle 1 to close it, the bottle 1 is cooled by an ordinary cooling device until its contents 6 are cooled down to room temperature, in view of the possibility that when the bottle 1 has been filled, its contents 6 may still remain at a temperature which will cause thermal deformation of the bottle 1.

If the bottle 1 is heat set beforehand, it requires only a short period of cooling subsequent to the filling of its contents 6, with a corresponding reduction in the time required for the entire process of filling the bottle 1.

While it is desirable that the cooling of the bottle 1 with the cooling fluid 10 should be effected uniformly over the whole surface of the bottle 1, its neck 2 is difficult to cool. Therefore, it is effective to increase the heat-resisting property of the neck 2 of the bottle 1 beforehand by whitening under heat control when the bottle 1 is molded.

When the liquid 6 has been poured into the bottle 1 forcibly cooled by the cooling fluid 10, it still remains at a fairly high temperature, since it is not directly cooled by the cooling fluid 10.

Figure 2:
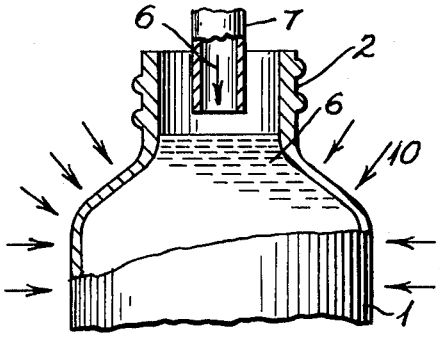
FIGS. 2 through 5 are fragmentary longitudinal cross-sectional views showing the sequence of operation from the pouring of a hot liquid into the bottle to the closing thereof, FIG. 2 showing the step of pouring, FIG. 3 the step of fitting an inner stopper, FIG. 4 the step of closing the bottle completely and FIG. 5 being an enlarged, fragmentary longitudinal section.
Figure 3:
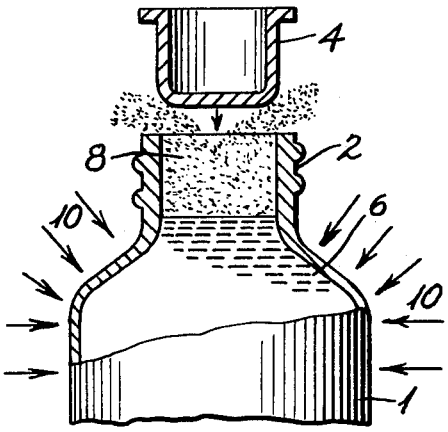
Figure 4:
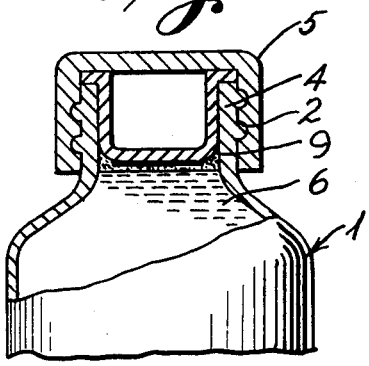

Accordingly, if the hot liquid 6 is poured through an injection tube 7 to fill the bottle 1 up to a level close to its neck 2 as shown in FIG. 2, the difference between the temperature of the liquid 6 and the ambient temperature causes vapor to rise from the liquid and fill a vacant space 8 formed above the liquid 6 in the bottle 1.

The injection tube 7 is moved upward relative to the bottle 1 and removed from its neck 2, while the vacant space 8 still remains full of such vapor of the liquid 6, i.e., while the liquid 6 still remains at a sufficiently high temperature.

Then, while the liquid 6 remains at a high temperature, i.e., while the vacant space 8 remains full of the vapor of the liquid 6, an inner stopper 4 is tightly fitted into the neck 2 to close it, and has a bottom surface positioned in contact with the level of the liquid 6 or slightly above it to eliminate or virtually eliminate a vacant space contacting the liquid 6 in the bottle 1.

After the neck 2 is closed by the inner stopper 4, an outer cap 5 is placed over the neck 2, and the contents 6 of the bottle 1 are cooled to room temperature, followed by transfer of the bottle 1 to an appropriate place.

The method described above prevents entry of air into the vacant space 8 in the neck 2, since the vacant space 8 above the liquid 6 is full of the vapor rising from the liquid 6 when the inner stopper 4 is fitted while the liquid 6 in the bottle 1 remains at a sufficiently high temperature to continue vaporization.

Since no air enters the space 8 in the neck 2, but it is full of the vapor from the liquid 6, no air is retained in a gap 9, if any, formed between the inner stopper 4 and the liquid 6 (see FIG. 5), but only the vapor of the liquid 6 is present in such a gap 9.

Thus, no air is captured in the bottle 1 at all, and therefore, there is no fear of any germs in the air being confined in the bottle 1.

Figure 5:
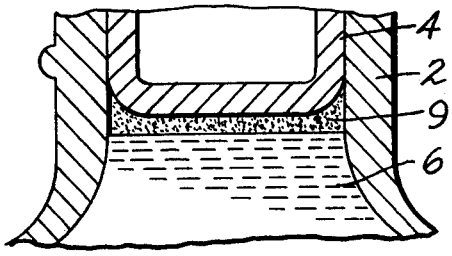

If there is any gap 9 between the inner stopper 4 and the liquid 6 as shown in FIG. 5, only the vapor of the liquid 6 fills the gap 9, and when the liquid 6 is cooled to about room temperature, the vapor in the gap 9 returns into the liquid 6 and the gap 9 become vacuum.

This serves to enhance the function of the inner stopper 4 in closing the neck 2 sealingly.

While the inner stopper 4 tightly fitted in the neck 2 to close it sealingly may be of any appropriate construction, it is often the case that as the bottle 1 which is a biaxially stretched polyethylene terephtahlate molding is less resistant to heat in its neck 2 than in its body portion, the liquid 6 fills the bottle 1 only to a level short of the neck 2 as shown in the drawings.

Accordingly, the vacant space 8 formed above the liquid 6 in the bottle 1 has a relatively large volume.

Therefore, the inner stopper 4 may conveniently be formed from a soft synthetic resin such as polyethylene, and comprise a bottomed cylindrical body having an outside diameter equal to the inside diameter of the neck 2, and a height positioning the bottom surface of the stopper 4 in contact with or slightly above the level of the liquid 6 when the stopper 4 is fitted in the neck 2, an integral flange being formed about the upper end of the cylindrical body to rest on the upper end of the neck 2, so that the stopper 4 can fill a relatively large vacant space in the neck 2 to ensure its closure in a sealed manner and can be molded easily and economically.

The outer cap 5 may be threadedly fastened to the neck 2 as shown in the drawings, or may alternatively be caulked thereto.

If the outer cap 5 is of the type threadedly connected to the neck 2, it is desirable from the standpoint of appearance that the lower end of the outer cap 5 be positioned below the lower end of the inner stopper 4 in the neck 2 to make the inner stopper 4 invisible from the outside of the bottle 1.

Attention is now directed to a device for cooling the bottle 1 when it is being filled with its contents 6.

FIG. 6 shows the probably simplest form of a cooling device using cold water as the cooling fluid 10, which is coaxially mounted about the injection tube 7 for introducing the hot liquid 6 into the bottle 1 and adapted to supply a continuous flow of cooling water down the outer surface of the bottle 1.

The injection tube 7 is vertically movable to position its lower end into the neck 2 of each of a series of bottles 1 arriving at a filling station one after another to fill the bottle 1 with its contents 6 which have been received from a source of liquid supply not shown.

A cylindrical seal cover 11 is positioned coaxially about the injection tube 7 to prevent entry into the neck 2 of any cooling water flowing down the outer surface of the bottle 1, and is molded in a cylindrical shape having an inside diameter somewhat larger than the outside of the neck 2.

According to the embodiment shown in the drawings, the cylindrical seal cover 11 has its inside diameter selected to position its lower end in sealing contact with a flange 3 formed around the outer surface of the lower end of the neck 2, so that no cooling water flowing down the outer surface of the bottle 1 may happen to flow toward the neck 2.

The cylindrical seal cover 11 is vertically movable like the injection tube 7, and may be movable either in unison with the injection tube 7 or independently thereof.

An outer cylindrical housing 13 is secured to the outer surface of the cylindrical seal cover 11 at the lower end thereof in coaxial relationship therewith, and defines with the cylindrical seal cover 11 a water chamber 12 which is open at its lower end forming a water outlet 14 and closed at its upper end.

The water chamber 12 defined between the cylindrical seal cover 11 and the outer cylindrical housing 13 does not need to be of any large volume, since it is not intended to serve as a sort of "pool" as in any other ordinary fluid passage.

In fact, the water chamber 12 is provided to receive a supply of cooling water from a substantially restricted source and distribute it almost uniformly around the bottle 1 when it flows down its outer surface. Therefore, the water chamber 12 is preferably provided between its inlet 15 and outlet 14 with an appropriate deflector to cause the water to flow substantially uniformly through the entire area of the outlet 14 which is annular in shape.

The inlet 15 opens into the upper end of the water chamber 12 and receives cooling water from a source of water supply not shown through a supply pipe 16.

According to the cooling device of FIG. 6 constructed as described above, the injection tube 7 and the cylindrical seal cover 11 are moved downwardly relative to the bottle 1 and the injection tube 7 is inserted into the neck 2, while the lower end of the cylindrical seal cover 11 is brought into sealing contact with the flange 3, when the bottle 1 has been received in the liquid filling station.

The source of water supply is, then, actuated to supply cooling water through the outlet 14 of the water chamber 12 down along the outer surface of the bottle 1 to cool it before the injection tube 7 starts introduction of a liquid into the bottle 1.

Thus, the hot liquid 6 is introduced into the bottle 1 being cooled by the water which continually flows down the outer surface of the bottle 1 in contact with it to keep it cooled.

Accordingly, the wall per se of the bottle 1 is never heated by its contents 6 to a temperature so high as to cause its deformation, but is entirely free from any influence of the high temperature of the liquid 6.

Although it may appear sufficient to continue the supply of cooling water to the outer surface of the bottle 1 until the bottle 1 has been filled with its contents 6, discontinuation of the supply of cooling water 10 immediately upon completion of the filling of the liquid 6 may possibly cause the bottle 1 to be affected by the heat of its contents 6 despite its prior cooling, since the liquid 6 still remains at a high temperature.

Therefore, the bottle 1 is continuously cooled by this cooling device until its contents are cooled in the cooling process immediately following the present bottle filling process.

FIG. 7 shows another embodiment of the cooling device, which uses water as the cooling fluid 10 like the device of FIG. 6, but which is designed to provide a more uniform supply of cooling water around the outer periphery of the bottle 1 than the device shown in FIG. 6.

The cooling device shown in FIG. 7 principally comprises a housing 13 which is movable relative to the bottle 1 no later than the injection tube 7 is moved downwardly relative to the bottle 1 and inserted into its neck 2, and which has a wall 18 positioned opposite to the outer surface of the bottle 1 at least in an area extending from its shoulder to its body portion upon such movement of the housing 13.

The housing 13 has a hollow interior, and its wall 18 is pierced with a multiplicity of outlet openings 14. The hollow interior of the housing 13 is fluidly communicated with a source of supply of a cooling fluid 17 by a supply pipe 16 connected to an inlet opening 15.

The cooling fluid supplied from its source of supply 17 into the housing 13 is spouted through the outlet openings 14 against the outer surface of the bottle 1 to cool the bottle 1.

In the embodiment shown, the hollow interior of the housing 13 is divided into two chambers, one on the side of the inlet opening 15 and the other on the side of the outlet openings 14, by a partition having a multiplicity of apertures 21, so that the cooling fluid introduced into the housing 13 through its inlet opening 15 may reach all the outlet openings 14 as uniformly as possible.

While a variety of arrangements may be possible for mounting the housing 13, it is, according to the present embodiment, secured to the lower end of a cylindrical seal cover 11 positioned coaxially with the injection tube 7, and having an inside diameter greater than the outside diameter of the neck 2 and a lower end adapted to be brought into abutment with the flange 3.

The housing 13 is connected at its lower end to the cylindrical seal cover 11, with its lower end resting on the flange 3, for the purpose of preventing any cooling fluid from entering the neck 2 during the cooling operation for the bottle 1.

The housing 13 has a part-spherical shape, and is directly connected to the cylindrical seal cover 11.

According to the embodiment of FIG. 7, cooling water is poured out through the outlet openings 14 of the wall 18 against the outer surface of the bottle 1 in a region from its shoulder to its body portion, so that the water directed against the bottle 1 in the vicinity of its shoulder may adhere to the outer surface of the bottle 1 and flow down to cool its lower portion not faced by the wall 18 of the housing 13.

FIGS. 8 and 9 show cooling devices adapted to use a gas as the cooling fluid 10.

The device shown in FIG. 8 includes a cylindrical housing 13 having a greater height than the body portion of the bottle 1 and a larger inside diameter than the outside diameter of the body portion of the bottle 1, and connected to the lower end of a cylindrical seal cover 11 by a seal plate 22.

The housing 13 has a wall 18 facing the bottle 1 in the whole area of its shoulder and body portion, and pierced with a multiplicity of outlet openings 14.

As has been the case with the device of FIG. 7, the interior of the housing 13 is divided by a partition 20 into two chambers, one on the side of its outlet openings 14 and the other on the side of its supply pipe 16, which are communicated with each other through a multiplicity of apertures 21 in the partition 20.

Each of the devices shown in FIGS. 8 and 9 can cool the bottle 1 by blowing a cooling gas against its outer surface through the outlet openings 14, and hold in a predetermined cooling atmosphere the bottle 1 filled with its hot contents 6.

Accordingly, each device can fullfil an extremely good cooling function to cool the bottle 1 uniformly over its entire surface.

While entry of any cooling fluid 10 into the neck 2 is prevented by the cylindrical seal cover 11 having its lower end resting on the flange 3 in all of the cooling devices shown in FIGS. 6, 7 and 8, FIG. 9 shows a different arrangement. The cooling device shown in FIG. 9 has a housing 13 divided into two horizontally movable portions along a vertical plane, and the two portions are horizontally moved toward each other with the bottle 1 in between to be united to form the housing 13 enclosing the bottle 1 therein.

Accordingly, infiltration of any cooling fluid 10 into the neck 2 is prevented by a pair of flat seal cover plates 22 secured to the two portions, respectively, of the housing 13.

The prevention of infiltration of the cooling fluid 10 into the neck 2 is accomplished by the edges of the two seal cover plates 22 facing the neck 2 and resting against its flange 2.

If the cylindrical seal cover 11 or the flat planar seal covers 22 forming a part of the cooling device exert an excessive pressure on the flange 3 when resting against it to prevent entry of the cooling fluid 10 into the neck 2, the flange 3 may likely be deformed by the heat of the liquid 6 filling the bottle 1, because it is molded integrally with the neck 2 which is difficult to cool.

With particular reference to the use of the planar seal covers in an attempt to prevent infiltration of the cooling fluid 10 into the neck 2, a very serious disadvantage may occur in case the edges of the planar seal covers 22 are brought into contact with the inclined lower surface of the flange 3.

More specifically stated, it will be seen from FIG. 10 that the lower surface of the flange 3 defines an upwardly inclined surface rising toward its outer periphery, and that, if the planar seal covers 22 are moved toward each other as in a mold closing operation to bring their opposing edges into contact with the lower surface of the flange 3, the seal covers 22 will exert an upwardly directed thrust on the flange 3 by virtue of the inclination of its lower surface.

No particular problem occurs when the planar seal covers 22 have been applied to the bottle 1, but as the liquid 6 begins to be introduced into the bottle 1, the hot liquid 6 heats the flange 3 and makes it liable to deformation, and due to the weight of the liquid 6 poured into the bottle 1, the flange 3 receives a stronger thrust from the seal covers 22.

Accordingly, the flange 3 is deformed or upwardly bent by the thrust of the seal covers 22 as shown in FIG. 11, with a resultant undesirable change in the tightening depth of the threaded cap to be placed over the neck 2 according to the construction shown in FIGS. 10 and 11.

A similar problem is likely to occur to the neck 2 of a bottle 1 provided about its upper end with an annylar flange 3 for receiving a caulked cap, if the flange 3 has an upwardly inclined lower surface as shown in FIG. 13. The flange 3 is deformed under the influence of the heat of the liquid 6 and the thrust imposed by the planar seal covers 22 as shown by broken lines in FIG. 13, and the cap cannot be properly placed over the flange 3.

The lower surface of the flange 3 should be made completely flat as shown in FIGS. 12 and 14 in order to prevent any such thermal deformation of the flange 3.

In other words, the lower surface should extend perpendicularly to the outer peripheral surface of the neck 2, and not at an angle thereto.

When the flange 3 has a horizontal lower surface as shown in FIGS. 12 and 14, the opposing edges of the planar seal covers 22 are merely brought into light contact with the lower surface of the flange 3 when applied to the neck 2 in order to prevent any cooling fluid 10 for the bottle 1 from flowing over its body portion toward its neck 2, and the seal covers 22 do not exert any thrust on the bottle 1 through its flange 3.

Therefore, even if the neck 2, including the flange 3, is slightly softened under the heat of the hot liquid 6 being poured through the injection tube 7 into the bottle 1, the flange 3 does not undergo any thermal deformation, but retains its initial shape, since no thrust or other external force whatsoever acts on the flange 3.

As the flange 3 is not deformed by the heat of the hot liquid 6, there is no fear any more of occurrence of a number of disadvantages which might otherwise occur, e.g., change in the tightening depth of a threaded cap, difficulty in proper positioning of a caulked cap, or incompletely sealed closure of the neck 2 by such a cap.

According to this invention, the effective cooling of the bottle 1 prior to the introduction of its contents 6 or simultaneously therewith advantageously prevents deformation of the bottle 1 by the heat of its contents 6 to thereby ensure the proper filling of the bottle 1 with its contents 6 and prevent degradation of the commercial value of its contents 6, and as the bottle 1 per se is not substantially heated, there is no fear of elution of any acetoaldehyde group from the polyethylene terephthalate material of the bottle 1, hence of the change in taste of its contents 6.

Moreover, as the method of this invention is simply intended to cool the bottle 1, it can easily be carried out only if a device for contacting a series of bottle 1 alternately with a cooling fluid 10 is mounted in the liquid filling station of a device for filling such a series of bottles 1 alternately with their contents 6.

It is, of course, necessary that the bottle cooling device be so constructed as not to interfere with the transfer of the bottles 1 into and out of the liquid filling device, and the cooling device is conveniently controlled for continuous operation irrespective of the presence of any bottle 1 to be cooled at any particular moment.

As the cooling devices are of the simple construction merely intended for causing a cooling fluid 10 to flow under gravity or directing it in jet form, they can easily be mounted in the liquid filling stations of the apparatus for pouring the liquid 6 continuously into a multiplicity of continuously arriving bottles 1, without interfering with the liquid filling devices or necessitating any structural modification thereof.

As is obvious from the foregoing description, this invention provides a great many excellent features and advantages, including the complete freedom of the bottle 1 from thermal deformation by its hot contents, hence maintenance of its high commercial value and its sealed closure by a cap placed over its neck; substantially complete freedom of the bottle 1 from any effect of heating by its hot contents 6, hence elimination of any possibility of elution of acetoaldehyde groups into the contents 6 resulting in a change in their taste; elimination of any confinement of germs from the air into the bottle 1 by utilizing the vapor rising from its contents 6, hence requiring no special facilities at all for shutting out such germs, but merely fitting an inner stopper 4 tightly into the neck 2, so that a very great hygienic effect can be obtained with simple operation and facilities to preserve the contents 6 of the bottle safely for a long period of time; and a very simple construction of the cooling devices and yet their highly reliable cooling efficiency.

What is claimed is:

1. An apparatus for filling a high temperature liquid 6 into a series of polyethylene terephthalate bottles 1 progressively fed into predetermined positions, said apparatus comprising an injection tube 7 adapted for relative downward movement into the neck 2 of a bottle 1 positioned stationarily at a predetermined position to pour a high temperature liquid 6 into said bottle 1; a vertically movable cylindrical seal cover 11 provided coaxially about said injection tube 7 and having a somewhat greater inside diameter than the outside diameter of said neck 2; and a housing 13 secured to the outside of said cylindrical seal cover 11 at the lower end thereof to define with said cylindrical seal cover 11 is cooling fluid chamber 12 having a closed upper end and an open lower end forming an outlet opening 14, said housing 13 having at its upper end an inlet opening 15 through which to communicate said chamber 12 with one end of a cooling fluid supply pipe 16.

2. An apparatus for filling a high temperature liquid 6 into a biaxially stretched polyethylene terephthalate molded bottle 1, said apparatus comprising an injection tube 7 for said high temperature liquid 6 adapted for relative downward movement into the neck 2 of each of a series of bottles 1 transferred progressively into predetermined positions; and a housing 13 adapted for movement no later than said injection tube 7 to be positioned opposite to said bottle 1, and having a wall 18 adapted to face the outer surface of said bottle 1 at least in a region extending from its shoulder to its body portion, said wall 18 being pierced with a multiplicity of outlet openings 14, said housing 13 being connected to a source of cooling fluid supply 17.

* * * * *